US007402225B2

(12) United States Patent
Droux

(10) Patent No.: US 7,402,225 B2
(45) Date of Patent: Jul. 22, 2008

(54) VEIL WITH A PVOH FIBRE BINDING AGENT

(75) Inventor: Michel Droux, La Ravoire (FR)

(73) Assignee: Saint-Gobain Vetrotex France S.A., Chambery (FR)

( * ) Notice: Subject to any disclaimer, the term of this patent is extended or adjusted under 35 U.S.C. 154(b) by 0 days.

(21) Appl. No.: 10/506,614

(22) PCT Filed: Mar. 19, 2003

(86) PCT No.: PCT/FR03/00869

§ 371 (c)(1),
(2), (4) Date: May 11, 2005

(87) PCT Pub. No.: WO03/078733

PCT Pub. Date: Sep. 25, 2003

(65) Prior Publication Data

US 2005/0255774 A1 Nov. 17, 2005

(30) Foreign Application Priority Data

Mar. 20, 2002 (FR) ..... 02 03443

(51) Int. Cl.
*D21H 13/00* (2006.01)
*B32B 37/00* (2006.01)

(52) U.S. Cl. ..... 162/145; 162/146; 162/148; 162/149; 162/156; 162/157.2; 156/62.2; 156/62.4; 156/296; 156/308.2; 156/309.6

(58) Field of Classification Search ..... 442/180; 162/145, 146, 148, 149, 156, 157.2; 156/62.2, 156/62.4, 296, 308.2, 309.6
See application file for complete search history.

(56) References Cited

U.S. PATENT DOCUMENTS

2003/0008586 A1 * 1/2003 Kajander et al. ..... 442/327

FOREIGN PATENT DOCUMENTS

| | | |
|---|---|---|
| DE | 28 35 935 | 3/1979 |
| FR | 2 709 485 | 3/1995 |
| WO | 01/75204 | 10/2001 |

* cited by examiner

*Primary Examiner*—Ula C Ruddock
(74) *Attorney, Agent, or Firm*—Oblon, Spivak, McClelland, Maier & Neustadt, P.C.

(57) ABSTRACT

The process according to the invention comprises:

Figure 1:
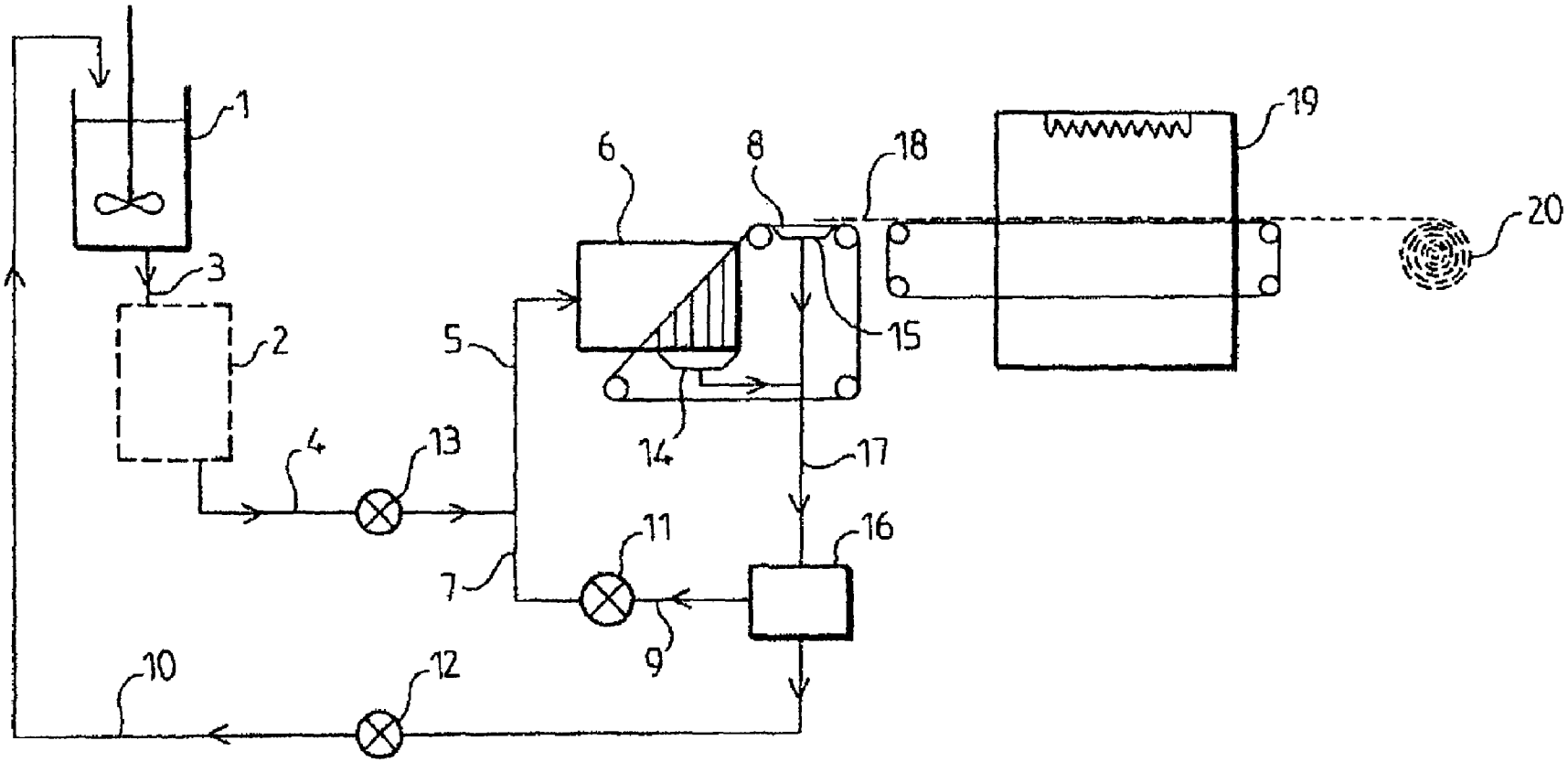

a step in which chopped filaments and discontinuous PVOH fibers are dispersed in a process water, followed by a step in which a bed is formed in a forming device by passing the dispersion over a forming cloth through which the process water is drained, the filaments and fibers being retained on said cloth, followed by a heat treatment step in a stoving device.

The PVOH fibers impart rigidity to the bed of fibers being formed. This process provides a veil with a very high tensile strength for low proportions of binder.

13 Claims, 1 Drawing Sheet

VEIL WITH A PVOH FIBRE BINDING AGENT

This is a national stage application of WO 03/078733 and claims priority to French application No 02/03443, filed on Mar. 20, 2002, which is incorporated herein by reference.

The invention relates to a process for the manufacture of a fiber veil in which the binder is derived from polyvinyl alcohol (PVOH) fibers. The veil manufactured according to the invention can be used especially as a wall covering. For this application it can be stuck to the walls on one side with a water-based adhesive and receive a paint (based on water or an organic solvent) on the other side.

"Veil" is understood as meaning a nonwoven consisting of completely dispersed filaments. In general, a veil has a weight per unit area ranging from 10 to 60 g/m$^2$ and more particularly 20 to 40 g/m$^2$, for example about 30 g/m$^2$.

The continuous manufacture of a veil involves passing a bed of dispersed filaments through several successive devices, each of which has to apply a specific treatment to said filaments. After it has been formed in a "forming device", the bed of fibers then passes through a "binder application device" followed by a "stoving device". The bed is conveyed through these devices by means of conveyor belts and is generally transferred from one belt to another. As it passes from one device to another by "belt hopping", the veil being formed tends to lose its cohesion, resulting in structural defects, such as a non-uniform weight, in the final veil.

The continuous process according to the invention comprises:

- a step in which chopped filaments and discontinuous PVOH fibers are dispersed in a process water, followed by
- a step in which a bed is formed in a forming device by passing the dispersion over a forming cloth through which the process water is drained, the filaments and fibers being retained on said cloth, followed by
- a heat treatment step in a stoving device.

The invention overcomes the problems mentioned above. In fact, as the PVOH fiber introduced at the start acts as a binder for the veil, it is not absolutely necessary to use a binder application device, which means that the veil has to undergo fewer "belt hops". Also, the Applicant discovered that the PVOH fibers gave rigidity to the bed being formed, probably due to the fact that the PVOH fiber imparts adhesiveness to the various ingredients of the bed and holds them together. The bed is thus damaged less during belt hopping.

To be dispersed in water, the filaments have to be able to remain in the individual state and not group together when mixed in the process water. If chopped yarns, an assembly of filaments, are dispersed in water, these yarns must be able to separate into filaments when dispersed in the water. "Yarn" is understood as meaning an assembly of contiguous filaments comprising more particularly from 10 to 2000 filaments. Thus the filaments, more particularly glass filaments, can be introduced into the process water in the form of yarns comprising more particularly 10 to 2000 filaments.

The filaments which can be used within the framework of the present invention generally comprise glass filaments and are more particularly glass filaments that are capable of being used for dispersion in the form of chopped yarns. The filaments may have been sized during manufacture, if appropriate so as to be assembled into yarns, especially with sizing liquids comprising an organosilane and/or a film former. It is preferable in this case not to dry the filaments before dispersing them in water, so as to avoid sticking the filaments together, which would hinder their dispersion as individual filaments.

Chopped filaments which can be used in addition to glass filaments are cellulose fibers (or "cellulose filaments", to use a synonym) and/or polyester filaments, especially polyethylene terephthalate (PET) filaments.

The cellulose fibers are generally obtained from wood pulp. This wood pulp is generally obtained from commercial sheets of cardboard, which are softened with water. This water used to soften the cardboard then serves to convey the pulp towards the plant where the dispersion is prepared. This water/pulp mixture generally contains just enough water to be able to convey the pulp by flowing. Before reaching the dispersion medium, this pulp/water mixture generally contains from 70 to 99% by weight of water and 1 to 30% by weight of cellulose. In general, the polyester filaments are chopped and have a length ranging from 3 to 25 mm and a diameter ranging from 7 to 20 μm. The polyester filaments marketed under the reference EP133 by Kuraray may be mentioned as polyester filaments which can be used.

A glass filament/cellulose fiber mixture is used more particularly as chopped filaments within the framework of the present invention when a good tear strength is sought.

A glass filament/polyester filament mixture is used more particularly as chopped filaments within the framework of the present invention when a good tear strength and an improved appearance of the veil are sought. In fact, polyester filaments give the veil a more uniform appearance.

The PVOH fibers are discontinuous and generally have a length ranging from 3 to 15 mm and a diameter ranging from 7 to 20 μm.

In the first step, the chopped filaments and PVOH fibers are dispersed in water, for example in a pulper. The aqueous solution in which the chopped filaments and PVOH fibers are dispersed is called process water. This dispersion can initially be prepared in a pulper, for example with a proportion of filaments and fibers such that the total weight of filaments+fibers ranges from 0.01% to 0.5% of the total weight of filaments, fibers and process water.

Preferably, at the moment when it enters the bed forming step, the filament/fiber/process water mixture is such that the total weight of filaments+fibers represents 0.01 to 0.5%, and preferably 0.02 to 0.05%, of the weight of said mixture. The concentration of filaments+fibers in the mixture may decrease as it passes from the pulper to the bed forming device.

The weight of PVOH fibers used represents preferably 1.5 to 20%, and particularly preferably 2.5 to 15%, of the total weight of chopped filaments and PVOH fibers.

It is possible to use only glass filaments as the chopped filaments.

Other chopped filaments which can be used are a mixture of glass filaments and cellulose fibers, especially in a glass/cellulose weight ratio of 99/1 to 80/20, and preferably of 95/5 to 90/10, it being understood that the weight of glass filaments takes account of any size they may contain.

Other chopped filaments which can be used are a mixture of glass filaments and polyester filaments, especially in a glass/polyester weight ratio of 99/1 to 70/30, and preferably of 90/10 to 80/20. The process water can comprise a thickener to increase its viscosity. This thickener can be present in the process water in an amount of 0 to 0.5% by weight, a possible example of said thickener being a hydroxyethyl cellulose (e.g. Natrosol 250HHR from Hercules).

The process water can comprise a cationic dispersant. This cationic dispersant can be present in the process water in an amount of 0 to 0.1% by weight. A possible example of said cationic dispersant is guanidine or an amine with a fatty chain. Aerosol C 61, marketed by CYTEC, can be used in particular.

The thickener is preferably introduced so that the process water has a viscosity of between 1 and 20 mPa·s, and preferably of between 5 and 12 mPa·s, at 20° C.

The process water/chopped filament dispersion is agitated and then transferred to a permeable forming cloth (which can also be called a belt) that lets the process water flow through it and retains the chopped filaments and PVOH fibers on its surface. The removal of the process water can be improved by suction. The process water can be recycled and mixed again with chopped filaments and PVOH fibers. The mixture of chopped filaments and PVOH fibers thus forms a bed on the surface of the forming cloth.

The forming cloth is a conveyor belt, i.e. a moving belt, that conveys the bed towards the stoving device.

It is not necessary to pass the formed bed through a binder application device insofar as the PVOH fiber used at the start serves as the binder for the final veil. However, it is not excluded to use a smaller amount of binder in the form of fibers introduced at the start, and to make up by adding binder in a binder application device located downstream from the bed forming device. It is therefore possible to incorporate 25 to 100% of the total weight of binder in the form of PVOH fibers introduced at the start, the remainder being applied in the binder application device.

The final veil comprises generally 1.5 to 15% by weight of binder (which can be exclusively PVOH) and more generally 2.5 to 10% by weight of binder (which can be exclusively PVOH), the remaining weight of the veil generally consisting of the weight of the filaments, including any sizing products which coat them. The veil according to the invention is generally based on glass filaments, i.e. it generally comprises at least 55% by weight of glass in the form of filaments. Thus the veil can comprise at least 80% by weight of glass in the form of filaments, especially in cases where only glass filaments have been used as the chopped filaments.

If the final veil comprises both glass filaments and cellulose fibers, these two types of component remain present in the final veil in the proportions in which they were introduced, as already stated.

If the final veil comprises both glass filaments and polyester filaments, these two types of component remain present in the final veil in the proportions in which they were introduced, as already stated. If it is chosen to apply part of the total binder in the binder application device, this is generally applied in the form of an aqueous dispersion:

- either by soaking between two forming cloths, in which case the product held between the two cloths is immersed in a bath via pairs of rollers,
- or by deposition on the bed of chopped filaments by means of a cascade, meaning that the aqueous dispersion of binder is run onto the sheet of chopped filaments in a stream perpendicular to said sheet and perpendicular to the direction of travel of said sheet.

The binder can be of the type normally used in this kind of process. In particular, it can be plasticized polyvinyl acetate (PVAc), styrene-acrylic, self-crosslinking acrylic, urea-formaldehyde or melamine-formaldehyde. The excess binder can be sucked away through the forming cloth.

The bed must enter the stoving device moist (between 20 and 70% by weight of water, for example about 40% by weight of water) so as to enable the polyvinyl alcohol fiber to dissolve in the water. This dissolution takes place under the effect of temperature, generally above about 60° C., the PVOH fiber converting to droplets of binder.

The purpose of the heat treatment step is to evaporate the water and effect any chemical reactions between the various constituents, for example condensation reactions of —OH groups. The heat treatment can be carried out by heating to between 140 and 250° C. The duration of the heat treatment generally ranges from 2 seconds to 3 minutes. The veil can be dried and heat-treated in an oven with hot air circulating through the belt. After the heat treatment, essentially all the PVOH fibers have been converted to PVOH binder and no longer appear in the form of fibers.

FIG. 1 diagrammatically shows a continuous process for the preparation of a veil according to the invention. The chopped filaments and the PVOH fiber are dispersed in a pulper 1 in the presence of process water, with agitation. The mixture may then be discharged into a storage tank 2 through the pipe 3, the purpose of the storage tank being to increase the mixing time of the filaments and the process water. This storage tank is optional. The mixture is then led through the pipe 4 to the pipe 5, which combines the flow of mixture coming from the pipe 4 with a flow of recycled process water coming from the headbox 6 through the pipe 7. At this point the proportion of filaments and fibers in the filament/fiber/process water mixture is greatly reduced. Process water is drained at 14 and optionally sucked at 15 through the forming cloth 8, and is recycled via the pipe 17. This recycled water is then divided at 16 so that e.g. about 10% returns to the pulper through the pipe 10 and about 90% returns to the headbox 6 through the pipes 9, 7 and then 5. Circulation in the pipes is assured by the pumps 11, 12 and 13. The pump 11 is called the fan pump. The veil being formed, 18, then undergoes a "belt hop" to the stoving device 19, and the final veil is rolled up at 20.

The invention provides a veil with a very high tensile strength for low proportions of binder, especially such that the following equation is satisfied:

$$R_T/(L.G)>0.03, \text{ or even } >0.035,$$

in which $R_T$ is the tensile strength in daN per 5 cm, L is the proportion of binder in the veil in % by weight and G is the weight of the veil in g/m$^2$. $R_T$ is determined by taking the mean of the two values obtained for the cross direction and the machine direction.

By way of comparison, for an identical proportion of binder, the tensile strengths of the veil according to the invention are twice those of a conventional veil bound by a urea-formaldehyde of very good specification (cf. the Examples in particular).

The veil according to the invention is more particularly intended for wall coverings. For this type of application it is not desirable for the veil to contain resin of the PVC type. The veil according to the invention is therefore generally such that it does not contain PVC.

In the Examples the tensile strength was measured according to Standard ISO 3342.

EXAMPLES 1 TO 3

Glass yarns chopped to a length of 18 mm are used, said yarns containing filaments of diameter 13 μm, said filaments being coated with a size comprising an organosilane and having a moisture content of 13% by weight. These yarns are used in the process of FIG. 1. The chopped glass yarns are introduced into the pulper so that their concentration in said pulper is 1.95 (Example 1), 1.9 (Example 2) and 1.8 (Example 3) grams per liter. PVOH fibers chopped to 4 mm (of mark Kuralon 105-2 marketed by Kuraray) are also introduced into the pulper so that their concentration in said pulper is 0.05 (Example 1), 0.1 (Example 2) and 0.2 (Example 3) grams per liter. The concentration of glass yarns is then diluted by a factor of 10 and the concentration of filaments+fibers on arrival at the forming cloth was 0.2 g/l. The concentration of PVOH fibers on arrival at the forming cloth was 0.005, 0.01 and 0.02 g/l respectively. The forming cloth traveled at a speed of 80 m/min and the flow rate of glass yarn/PVOH fiber/process water mixture discharging onto the cloth was 35 $m^3$/hour. The process water contained 0.1% by weight of hydroxyethyl cellulose (Natrosol 250HHR from Hercules) and 0.025% by weight of a cationic dispersant (aerosol C61 from Cytec). After drainage and suction of the excess water, the moist sheet contains 35% of water. The sheet is then dried in a hot-air oven at 180° C. for 20 seconds. The veil obtained is very homogeneous and has a weight per unit area of 50 g/$m^2$. It contains the amounts of PVOH indicated in Table 1, where the results are collated.

EXAMPLES 4 TO 9 (COMPARATIVE)

The procedure is as for Example 1 except that no PVOH fiber is introduced into the pulper, and except that a binder is added, downstream from the forming cloth and before drying, by discharging a cascade of a solution of PVOH or urea-formaldehyde onto the traveling sheet. The veils obtained all have a weight per unit area of 50 g/$m^2$. The results are collated in Table 1.

TABLE 1

| | PVOH fibers | | | Liquid PVOH | | | Urea-formaldehyde | | |
|---|---|---|---|---|---|---|---|---|---|
| Ex. no. | 1 | 2 | 3 | 4 | 5 | 6 | 7 | 8 | 9 |
| % by weight of binder in veil | 2.5 | 5 | 10 | 2.5 | 5 | 10 | 2.5 | 5 | 10 |
| tensile strength (daN/5 cm) | 5 | 10 | 20 | 2 | 4 | 8 | 2.5 | 5 | 10 |
| $R_T$/(L. G) | 0.04 | 0.04 | 0.04 | 0.016 | 0.016 | 0.016 | 0.02 | 0.02 | 0.02 |

The invention claimed is:

1. A continuous process for the manufacture of a veil comprising:

a. forming a dispersion of chopped filaments comprising glass filaments and discontinuous PVOH fibers in a process water, then b. forming a bed in a forming device by passing the dispersion over a forming cloth through which the process water is drained, said cloth being a conveyor belt, the filaments and fibers being retained on said cloth, then c. subjecting the bed to a heat treatment on a conveyor belt in a stoving device, wherein said veil comprises glass filaments and 1.5 to 15% by weight of a binder which comprises PVOH, wherein the passage from the forming device to the stoving device causes the bed to undergo at least one belt hop.

2. A process as claimed in claim 1, wherein the weight of PVOH fibers comprises 1.5 to 20% of the total weight of chopped filaments and PVOH fibers.

3. A process as claimed in claim 1, wherein the chopped glass filaments are introduced into the process water in the form of yarns comprising 10 to 2000 dispersible filaments.

4. A process as claimed in claim 1, wherein the weight of PVOH fibers comprises 2.5 to 15% of the total weight of chopped filaments and PVOH fibers.

5. A process as claimed in claim 1, wherein the PVOH fibers have a length ranging from 3 to 15 mm.

6. A process as claimed in claim 1, wherein at the beginning of the forming step, the total weight of filaments fibers represents 0.01 to 0.5% of the weight of the dispersion.

7. A process as claimed in claim 6, wherein at the beginning of the forming step, the total weight of filaments+fibers represents 0.02 to 0.05% of the weight of the dispersion.

8. A process as claimed in claim 1, wherein the process water comprises a thickener and has a viscosity of between 1 and 20 mPa·s at 20° C.

9. A process as claimed in claim 8, wherein the process water comprises a thickener and has a viscosity of between 5 and 12 mPa·s at 20° C.

10. A process as claimed in claim 1, wherein the veil comprises 2.5 to 10% by weight of binder.

11. A process as claimed in claim 1, wherein the PVOH fibers form 25 to 100% of the total weight of binder in the veil.

12. A process as claimed in claim 1, wherein the binder is exclusively PVOH.

13. A process as claimed in claim 1, wherein the veil comprises at least 80% by weight of glass in the form of filaments.

* * * * *